US009357838B2

(12) United States Patent
Berkowitz

(10) Patent No.: US 9,357,838 B2
(45) **Date of Patent: *Jun. 7, 2016**

(54) PORTABLE TABLE

(71) Applicant: Daniel Berkowitz, Devon, PA (US)

(72) Inventor: Daniel Berkowitz, Devon, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/539,719

(22) Filed: Nov. 12, 2014

(65) Prior Publication Data

US 2015/0201746 A1 Jul. 23, 2015

Related U.S. Application Data

(63) Continuation of application No. 13/836,400, filed on Mar. 15, 2013, now Pat. No. 8,915,195.

(51) Int. Cl.

| | |
|---|---|
| ***A47B 85/00*** | (2006.01) |
| ***A47B 3/04*** | (2006.01) |
| ***A47B 3/12*** | (2006.01) |
| ***A47B 13/16*** | (2006.01) |
| ***A47B 3/00*** | (2006.01) |
| ***A47B 3/10*** | (2006.01) |
| ***A47B 3/06*** | (2006.01) |
| *A47B 9/14* | (2006.01) |

(52) U.S. Cl.

CPC . *A47B 3/04* (2013.01); *A47B 3/002* (2013.01); *A47B 3/06* (2013.01); *A47B 3/10* (2013.01); *A47B 3/12* (2013.01); *A47B 13/16* (2013.01); *A47B 9/14* (2013.01); *A47B 2003/045* (2013.01)

(58) Field of Classification Search

CPC ..... A47B 13/16; A47B 3/02; A47B 3/06; A47B 3/083; A47B 3/091; A47B 3/00

USPC ..... 108/25, 26, 115, 157.1, 155.18, 159.12, 108/157.18, 155

See application file for complete search history.

(56) References Cited

U.S. PATENT DOCUMENTS

| | | | |
|---|---|---|---|
| 4,122,780 | A | 10/1978 | Brickman |
| D252,659 | S | 8/1979 | Brickman |
| 4,625,655 | A | 12/1986 | Brickman |
| 5,421,273 | A | 6/1995 | Lin |
| D387,583 | S | 12/1997 | Shear |
| 5,865,127 | A | 2/1999 | Carter |
| 5,884,566 | A | 3/1999 | Chen |
| 5,913,269 | A | 6/1999 | Franssen et al. |
| 6,073,894 | A | 6/2000 | Chen |
| 6,158,361 | A | 12/2000 | Zheng et al. |
| 6,199,489 | B1 | 3/2001 | Tsai |
| 6,234,089 | B1 | 5/2001 | Zheng et al. |
| 6,283,045 | B1 | 9/2001 | Izumi |
| 6,439,133 | B1 | 8/2002 | Jaramillo |
| 6,505,565 | B1 | 1/2003 | Byung et al. |
| 6,662,732 | B2 | 12/2003 | Birsel et al. |

(Continued)

*Primary Examiner* — Jose V Chen

(74) *Attorney, Agent, or Firm* — John F. A. Earley, III; Frank J. Bonini, Jr.; Harding, Earley, Follmer & Frailey, P.C.

(57) ABSTRACT

A portable collapsible table, having a foldable supporting frame that supports a table top, the frame including a plurality of legs that are positionable in a first position that positions the table top in a first relatively low position and that are positionable in a second position that positions the table top in a second relatively raised position, the table top including a plurality of wells disposed therein, the wells, the frame and the table top being collapsible so that the table may be folded for ease in storage or transport thereof.

27 Claims, 7 Drawing Sheets

(56) References Cited

U.S. PATENT DOCUMENTS

| | | | | |
|---|---|---|---|---|
| D498,088 | S | 11/2004 | Tsang | |
| 6,889,618 | B1 | 5/2005 | Gromack | |
| 6,929,230 | B2 | 8/2005 | Tsai | |
| D511,911 | S | 11/2005 | Light et al. | |
| 6,997,111 | B2 | 2/2006 | Giegerich | |
| 7,131,364 | B2 | 11/2006 | Brazell | |
| D536,394 | S | 2/2007 | Meoli et al. | |
| 7,765,941 | B2 | 8/2010 | Chen | |
| 8,327,774 | B1 | 12/2012 | Rivera | |
| 8,424,470 | B2 | 4/2013 | Volin | |
| 8,915,195 | B2 * | 12/2014 | Berkowitz | 108/25 |
| 2003/0094123 | A1 | 5/2003 | Ulmer | |
| 2004/0051009 | A1 | 3/2004 | Chen | |
| 2004/0084581 | A1 | 5/2004 | Chang | |
| 2005/0199162 | A1 | 9/2005 | Hendricks et al. | |
| 2008/0178776 | A1 | 7/2008 | Arias et al. | |
| 2009/0241811 | A1 | 10/2009 | Markegard et al. | |

* cited by examiner

PORTABLE TABLE

BACKGROUND OF THE INVENTION

1. Field of the Invention

The present invention relates to tables, and more particularly to a folding, portable table.

2. Brief Description of the Related Art

A variety of tables are known and used. There are portable tables that have foldable legs, such as, "card" tables, which permit the table to occupy less space in a folded condition so the table may be readily stored. However, although these tables are foldable, they also are heavy, and are not readily transportable without considerable effort, or the use of a vehicle. Other attempts have been to provide the table top separate from the frame.

A number of table frames and table tops are disclosed in the following U.S. patent documents: U.S. Pat. No. 6,158,361 Zheng et al, issued on Dec. 12, 2000; U.S. Pat. No. 6,234,089 Zheng et al issued on May 22, 2001; U.S. Pat. Appln. 2008/0178776, published on Jul. 31, 2008; U.S. Pat. Appln. 2005/0199162 published on Sep. 15, 2005; and U.S. Pat. Appln. 2003/0094123 published on May 22, 2003.

A need exists for a table that is lightweight and portable and which may be collapsed for storage and transport.

SUMMARY OF THE INVENTION

A lightweight, foldable table that may be readily collapsed for transport or storage is provided.

According to a preferred embodiment, the table frame is comprised of foldable legs and supports that are slidably and/or pivotally connected to collapse when desired.

According to a preferred embodiment, the table top is removable from the supporting frame and is constructed to be folded, and the frame is detachable from the table top and collapsible. According to preferred embodiments, the table may be collapsed and folded into a semi-circle.

It is an object of the invention to provide a collapsible table having a table top featuring a surface with a plurality of beverage holders provided therein.

It is a further object of the invention to provide preferred embodiments where the beverage holder is comprised of a collapsible sleeve that extends below the table top surface. A beverage container may be placed in the sleeve.

It is another object of the invention to provide a table having an adjustable height. According to a preferred embodiment, the table top may be positioned at a first height and a second height, as desired. The first height, for example, may be designated as a standard table height of about 24 inches, while the second height may be the height of 36 inches, which can be used for standing, or in connection with bar stool/higher chair type seating.

BRIEF DESCRIPTION OF THE DRAWING FIGURES

DETAILED DESCRIPTION OF THE PREFERRED EMBODIMENTS

Figure 1:
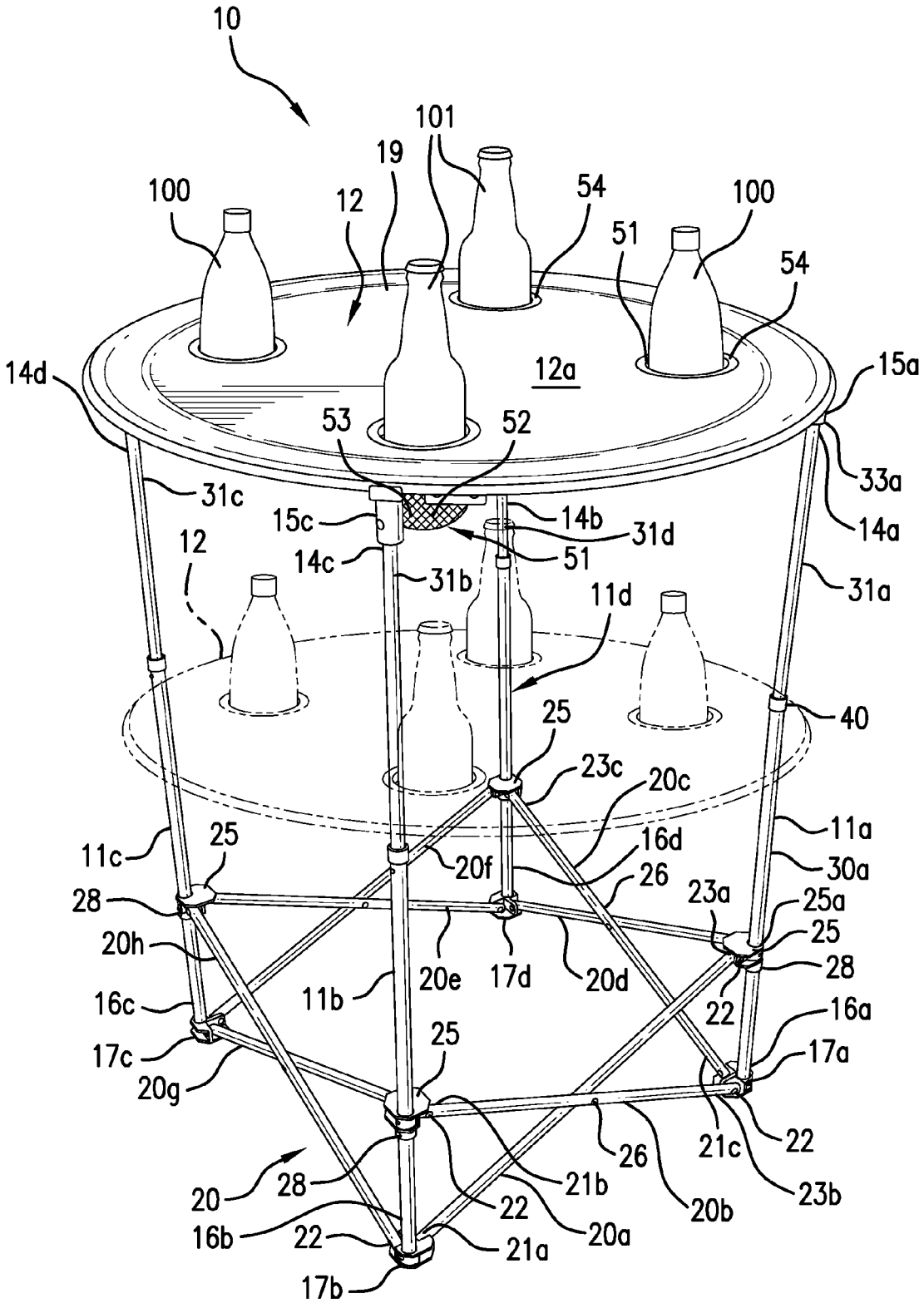
FIG. 1 is a perspective view of a foldable table according to my invention showing the table in a raised condition with the legs extended, as viewed looking down on the table from the front left.
Figure 2:
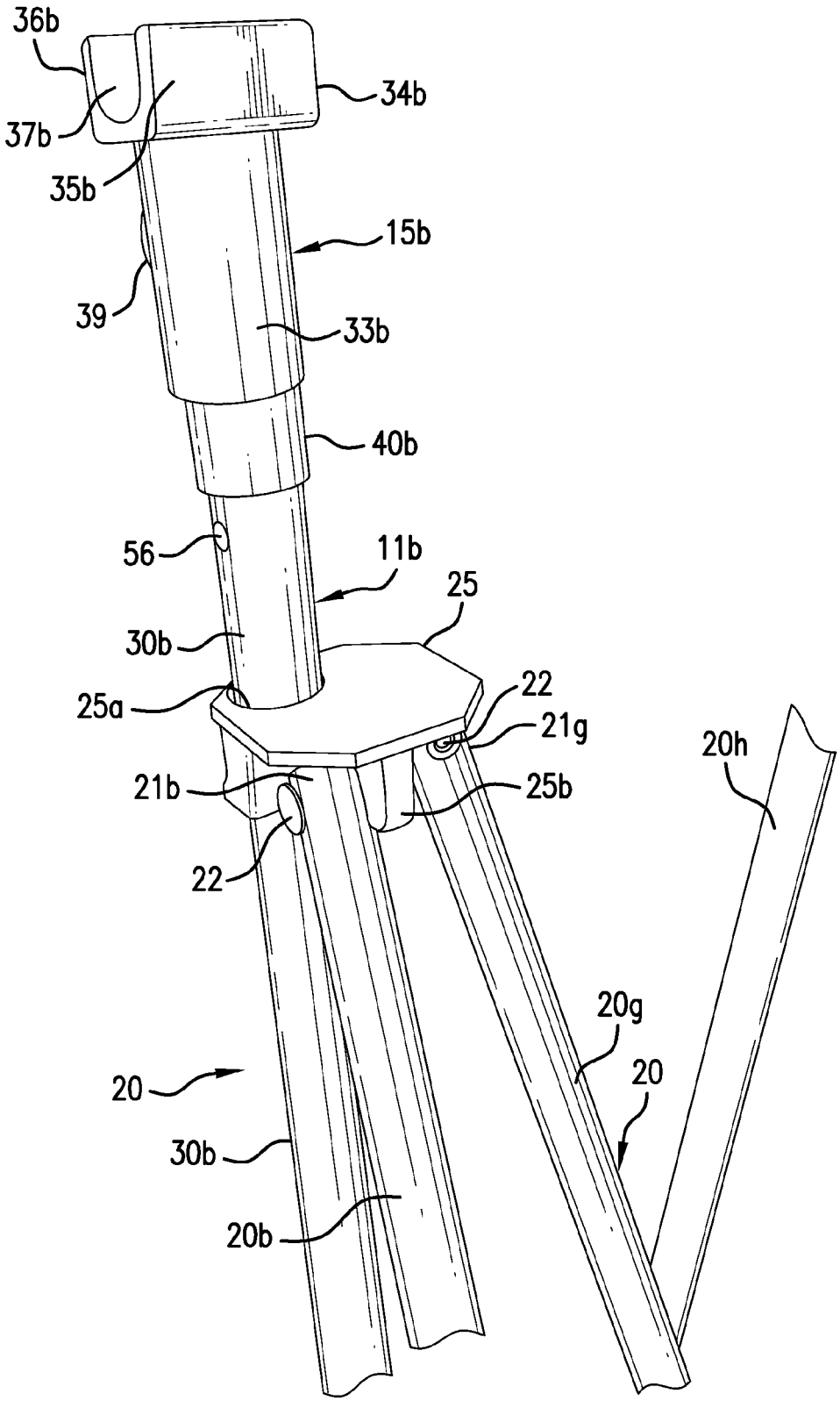
FIG. 2 is an enlarged view of a slider and support members connected thereto, shown separately from the other components of the table.
Figure 5:
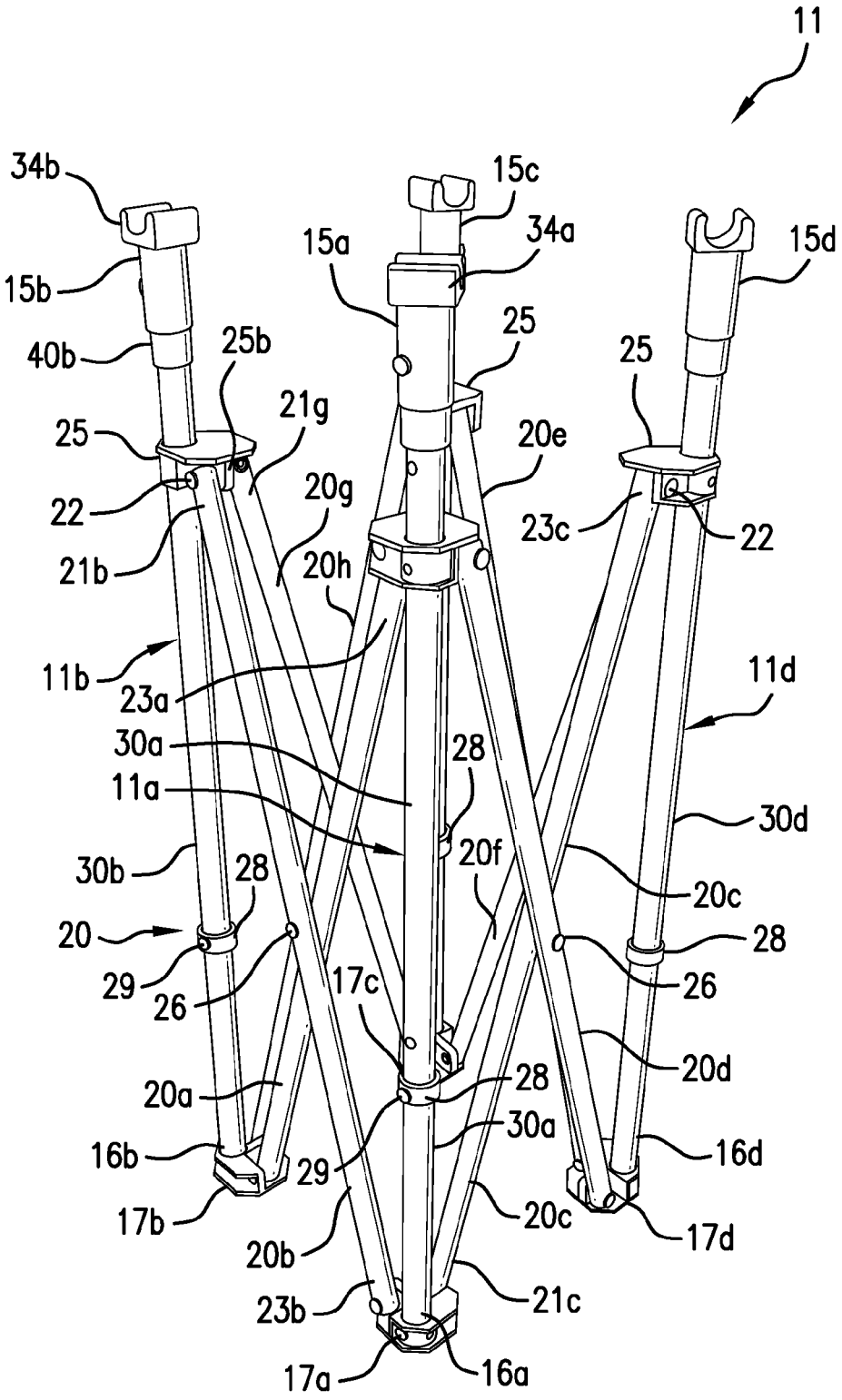
FIG. 5 is a perspective view of the frame of the table of FIG. 1, shown separate from the table top and being illustrated in a partially collapsed/partially expanded condition.
Figure 6:
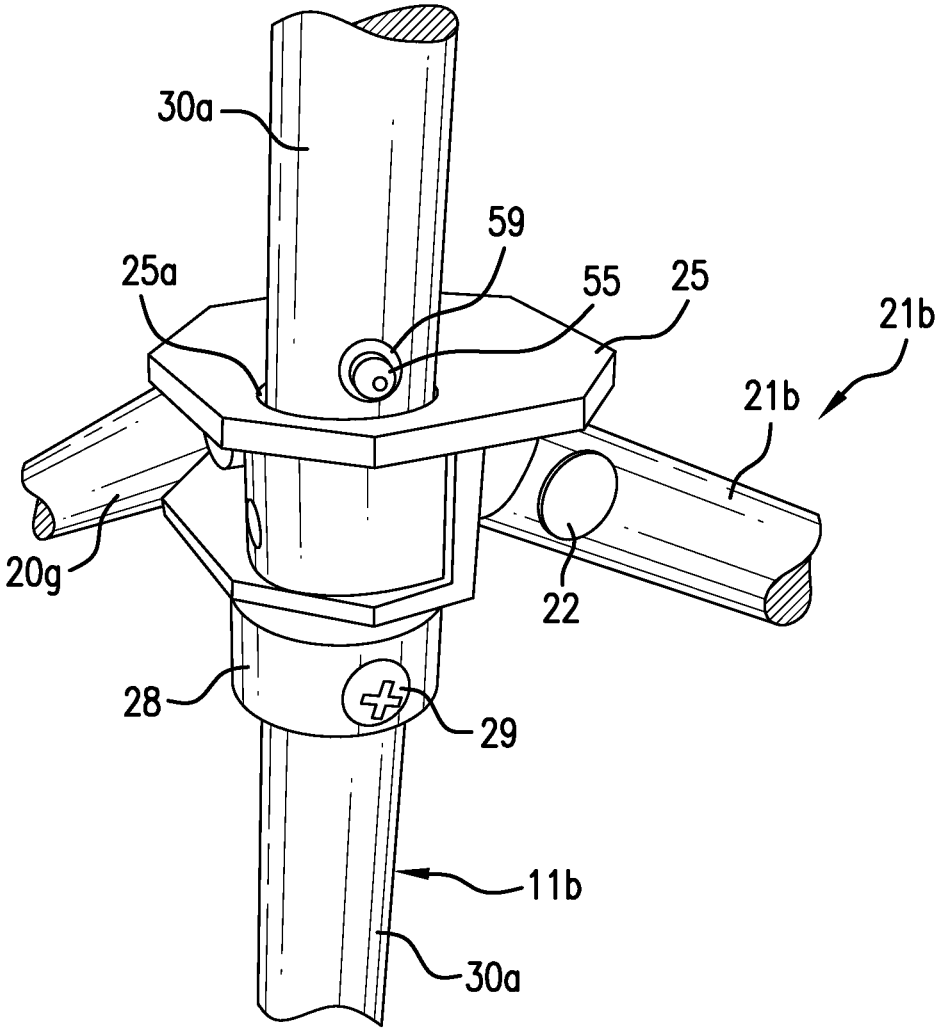
FIG. 6 is a perspective view of a portion of the lower frame support and a leg, in partial view, shown in a condition where the frame is expanded and the legs are positioned for supporting the table top at a relatively lower height.

Referring to the drawing figures, a foldable table 10 is shown having a frame 11 and a top 12. The frame 11 includes a plurality of upstanding legs 11*a*,11*b*,11*c*,11*d*, which are vertically disposed and support the table top 12. Preferably, the legs 11*a*,11*b*,11*c*,11*d* connect with an upper frame support 18 (FIG. 3) that supports the table top 12. The legs 11*a*,11*b*,11*c*,11*d* preferably have upper ends, 14*a*,14*b*,14*c*,14*d*, respectively, which are shown received in the upper connectors 15*a*,15*b*,15*c*,15*d*. The legs 11*a*,11*b*,11*c*,11*d* also have lower ends 16*a*,16*b*,16*c*,16*d*, respectively, which connect to lower connectors 17*a*,17*b*,17*c*,17*d*, respectively. The lower connectors 17*a*,17*b*,17*c*,17*d* preferably form the feet that are designed to rest on a surface, such as the ground or floor, and support the weight of the table 10. The frame 11 is shown having a lower support 20. Preferably the lower support 20 comprises a plurality of support members 20*a*,20*b*,20*c*,20*d*,20*e*,20*f*,20*g*,20*h*, which are arranged to support the table 10. According to a preferred embodiment, the support members 20*a*,20*b*,20*c*,20*d*,20*e*,20*f*,20*g*,20*h* each have a first end and a second end. As illustrated in connection with the support member 20*a*, the first end 21*a* of support member 20*a* is shown pivotally connected to the lower connector 17*b* with the fastener 22. The other end or second end 23*a* of the support member 20*a* is pivotally connected to a slider 25 that rides along the adjacent leg 11*a*. The slider 25 preferably has an aperture 25*a* therein (see FIG. 2). As best shown in FIGS. 1, 2 and 6, a fastener 22 is used to connect the support member second end 23*a* to the slider 25. The support member 20*a* preferably is connected to the support member 20*b* at a location between the support member first end 21*a* and second end 23*a*. As best shown in FIGS. 1, 2 and 6, the connection between support members 20*a*, 20*b* preferably is a pivot connection that may be made with a fastener 26. The first end 21*b* of the second support member 20*b* is shown making a pivotal connection to the slider 25 that rides along the second leg 11*b*. The second end 23*b* of the second support member 20*b* is shown making a pivotal connection to the lower connector 17*a*. A fastener 22 may be used to secure the pivotal connections of the first end 21*b* and second end 23*b* of the support member 20*b* with the respective connections to the slider 25 and lower connector 17*a*. As illustrated in the figures, the support member pairs 20*c*,20*d* are connected to the sliders 25 on the first leg 11*a* and fourth leg 11*d*, respectively, in the same manner as the pair of support members 20*a*,20*b* described herein, with the first end 21*c* of the third support member 20*c* being pivotally connected to the lower connector 17*a*, and the second end 23*c* of the support member 20*c* being pivotally connected to the slider 25 on the fourth leg 11*d*. Suitable fasteners are used to make the pivotal connections, such as, the fasteners 26 which may pivotally connect the legs 20*c*,20*d* together and fasteners 22 used for securing the pivotal connections made between the support members 20*c*,20*d* and the respective sliders 25 and lower connectors 17*a*,17*d*. Support members 20*e*,20*f*, and support members 20*g*,20*h*, preferably are secured to the legs 11*d*,11*c* and legs 11*c*,11*b*, respectively, and fasteners 22 are used to secure the pivotal connections made with the respective sliders 25 and respective lower connectors 17*d*,17*c*,17*b*, as best illustrated in FIGS. 1 and 5.

Referring to FIG. 2, the enlarged view shows the slider 25 having a first arm 25*b* to which the first end 21*b* of the second support member 20*b* is shown pivotally connected with the fastener 22. The first end 21*g* of the seventh support member 20*g*, is shown pivotally connected to a second arm (not shown) of the slider 25 with a fastener 22. According to preferred embodiments, lower stops 28 (FIGS. 1 and 5) are provided on each leg 11*a*,11*b*,11*c*,11*d*, and, more preferably, on each lower leg section 30*a*,30*b*,30*c*,30*d*, to limit the movement of each slider 25 in the downward direction of the leg. When the table 10 is in a fully open condition, with the frame 11 unfolded as in FIG. 1, the sleeves 25 preferably are engaged on or limited by the lower stops 28. The lower stops 28 are illustrated according to a preferred embodiment comprising annular rings that are disposed about the circumference of each lower leg 11*a*,11*b*,11*c*,11*d*, and preferably, the lower stops 28 are mounted on each leg 11*a*,11*b*,11*c*,11*d* with a suitable mounting means, such as, for example, the screws 29.

Each leg 11*a*,11*b*,11*c*,11*d* preferably is comprised of two sections, including a first or lower section 30*a*,30*b*,30*c*,30*d* and a second or upper section 31*a*,31*b*,31*c*,31*d*. The first leg 11*a* is shown comprised of a lower leg section 30*a* and an upper leg section 31*a*. According to a preferred embodiment, the leg sections 30*a*,31*a* are telescopic members. As illustrated in FIG. 1, in accordance with a preferred configuration, the lower leg section 30*a* of the leg 11*a* is tubular in structure and slidably receives the upper leg section 31*a* therein. The other legs 11*b*,11*c*,11*d* preferably may be constructed in the same manner as the first leg 11*a*, with lower leg sections 30*b*,30*c*,30*d* and respective upper leg sections 31*b*,31*c*,31*d*, which respectively, are received therein. The upper leg section 31*a* has a first end that is disposed within the tubular lower leg section 30*a*, and a second end 14*a* that is connected to an upper connector 15*a*. The upper connector 15*a* preferably includes a sleeve 33*a* to which the second end 14*a* of the leg 11*a*, and preferably of the upper leg section 31*a*, is connected. Preferably, a portion of the upper leg section 31*a* is received within the sleeve 33*a*. A suitable fastener, such as, for example, a screw 39, secures the sleeve 33*a* on the upper leg section 31*a*. As illustrated in FIG. 2, an upper connector 15*b* is shown in an enlarged view having a sleeve 33*b* and a locking arm 34*b*, and being secured with a screw 39 to the upper leg section 31*b* (see FIG. 1).

According to a preferred embodiment, the legs 11*a*,11*b*, 11*c*,11*d* preferably are adjustable to allow the table 10 to be set up at different heights. According to one preferred embodiment, the table legs 11*a*,11*b*,11*c*,11*d* are constructed to hold the table top 12 at a first height and at a second height. The first height is obtained when preferably each sleeve 33*a*, 33*b*,33*c*,33*d* is resting on each stop 40*a*,40*b*,40*c*,40*d*. The second height or a raised height, may be obtained when the upper leg sections 31*a*,31*b*,31*c*,31*d* are raised relative to the lower leg sections 30*a*,30*b*,30*c*,30*d*, in which they slide. The upper leg sections 31*a*,31*b*,31*c*,31*d* are slidably drawn out from the lower leg sections 30*a*,30*b*,30*c*,30*d*. Preferably, a locking mechanism is provided to lock the upper leg sections 31*a*,31*b*,31*c*,31*d* at a raised height. According to a preferred embodiment, the locking mechanism is shown comprising a retractable pin 55 disposed in each upper leg section 31*a*,31*b*, 31*c*,31*d*. The retractable pin 55 preferably has a spring (not shown) on one end, and the pin 55 is biased outwardly from the leg in which it sits, so that when the pin 55 is depressed, the pin 55 is biased to return to a protruding position. According to a preferred embodiment, where the locking mechanism is provided on both the upper leg sections 31*a*,31*b*,31*c*,31*d* and lower leg sections 30*a*,30*b*,30*c*,30*d*, a pin 55 is carried in each upper leg section 31*a*,31*b*,31*c*,31*d*, and each lower leg section 30*a*,30*b*,30*c*,30*d* preferably has a mating locking mechanism, which is shown comprising an upper aperture 56 disposed in the upper portion of each lower leg section 30*a*, 30*b*,30*c*,30*d* (see FIG. 2). Each lower leg section 30*a*,30*b*, 30*c*,30*d* also has a lower aperture 59. The pins 55 preferably extend through the lower apertures 59 when the upper leg sections 31*a*,31*b*,31*c*,31*d* are lowered and the pins 55 are aligned with the lower apertures 59. According to a preferred embodiment, the positioning of a pin 55 in a respective lower leg section lower aperture 59 aligns the respective upper connector 15*a*,15*b*,15*c*,15*d* to position the connector arm 34*a*,34*b*,34*c*,34*d* to hold the table top 12 and upper support 18.

Although not shown, each upper leg section 31*a*,31*b*,31*c*, 31*d* preferably has an aperture therein in which the pin 55 is mounted. When the upper leg sections 31*a*,31*b*,31*c*,31*d* are raised from the lower leg sections 30*a*,30*b*,30*c*,30*d*, the pins 55 carried on the upper leg sections 31*a*,31*b*,31*c*,31*d* are forced inwardly by the walls of the lower leg sections 30*a*, 30*b*,30*c*,30*d*. In the embodiment illustrated, the pins 55 ride against the inner wall surfaces of the lower leg sections 30*a*, 30*b*,30*c*,30*d* until the upper leg sections 31*a*,31*b*,31*c*,31*d* are raised to a height where the pins 55 are aligned with the upper apertures 56 of the respective lower leg sections 30*a*,30*b*,30*c*, 30*d*. Optionally, although not shown, a track, key or other structure may be provided as a guide along which the pins 55 may slide when the upper leg sections 31*a*, 31*b*,31*c*,31*d* are raised and lowered. Upon reaching the upper apertures 56, the pins 55 release and extend through the upper apertures 56 to lock the legs 11*a*,11*b*,11*c*,11*d* in a raised position (see FIG. 1).

Figure 3:
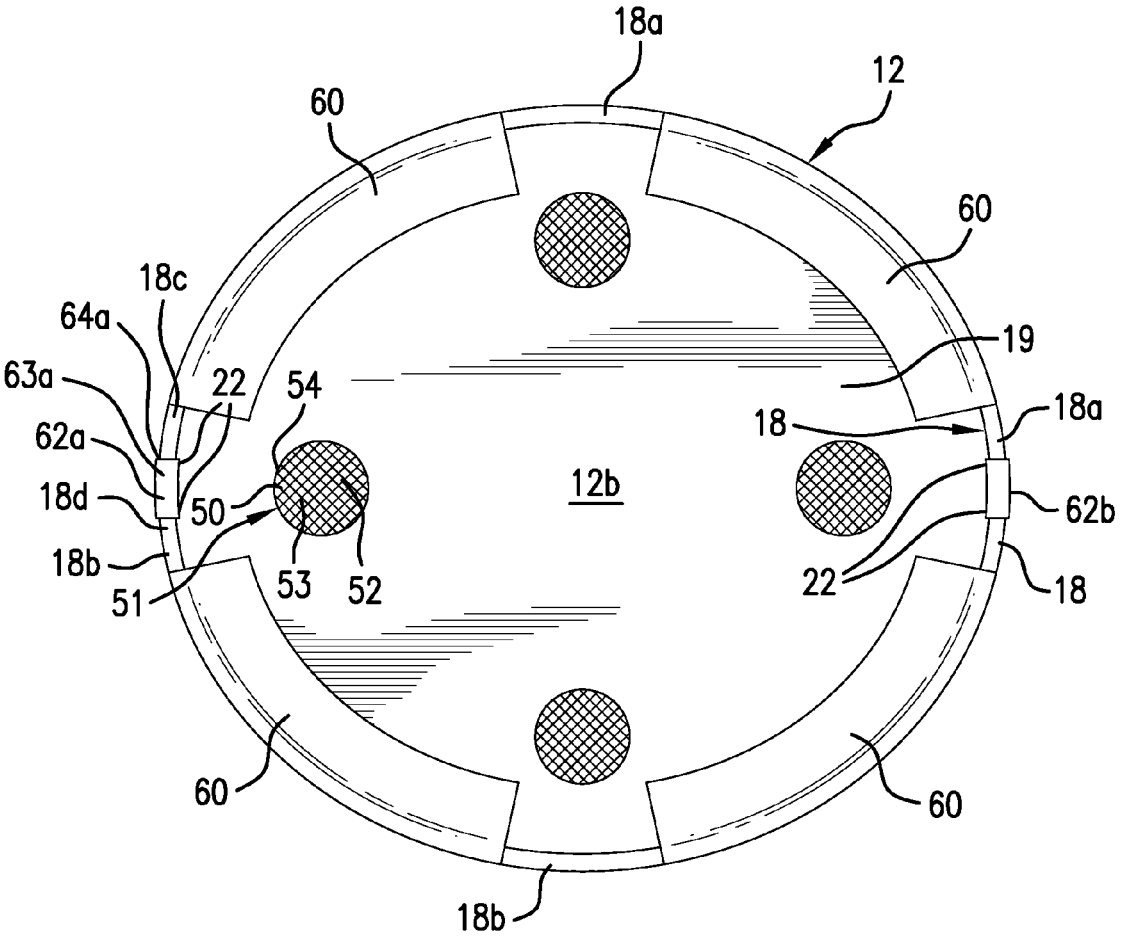
FIG. 3 is a bottom plan view looking at the underside of the table top, shown separately from the legs and lower frame support structure.
Figure 7:
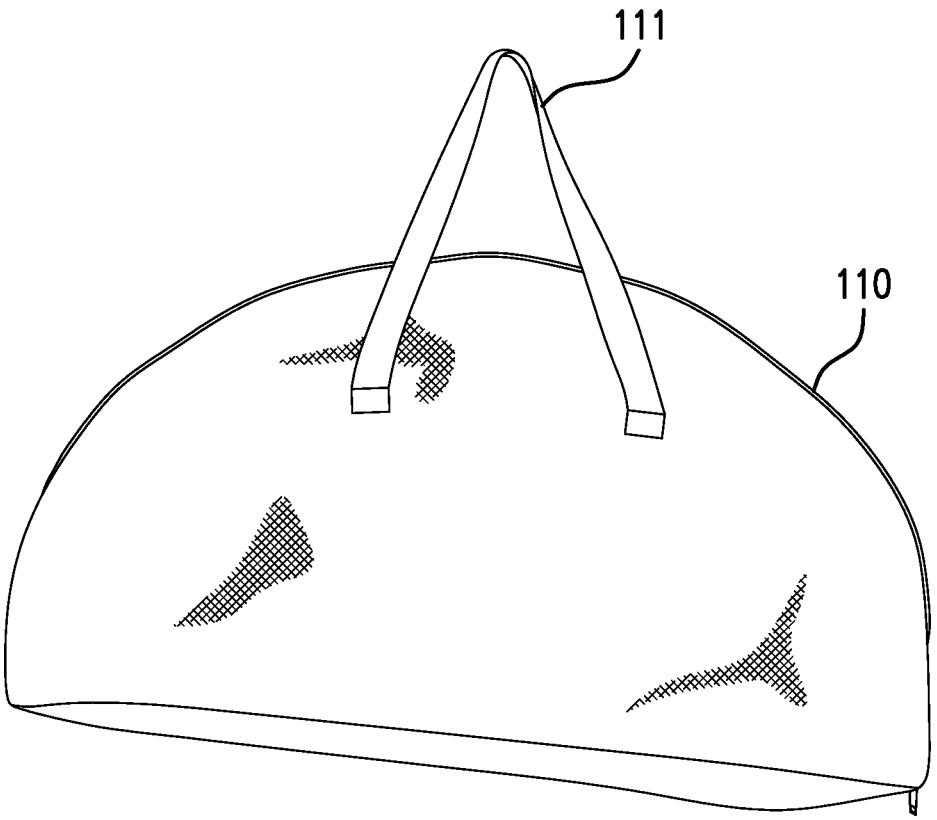
FIG. 7 is an illustration of a carrying case storing the table in a collapsed condition.

The table top 12 has a top surface 12*a* (FIG. 1) and bottom surface 12*b* (FIG. 3). Preferably, the table top surfaces 12*a*, 12*b* are constructed from a lightweight, washable material, such as, for example, polyester, which may comprise a single panel. One preferred material is a polyester 600 denier fabric. The table top 12 preferably is attached to the frame 11, and may be removably secured on the frame 11 with the use of a suitable securing component. Examples of securing components include surfaces of hooks and loop pile, snaps, threaded seams, welds, cords, posts and grommets and the like. According to a preferred embodiment, the table top 12 preferably is comprised of a flexible panel 19 securely attached to the upper frame support 18 so that when the panel 19 and upper support 18 are installed on the legs 11*a*,11*b*,11*c*,11*d*, the table top surface 12*a* is tensioned to provide a firm surface. According to a preferred embodiment, the fabric panel 19 is fixedly mounted on the upper support 18, and is attached so it may be folded along with the upper support 18 and placed in a carry bag 110 (see FIG. 7). According to alternate embodiments, the table top 12 may be constructed from a removable panel.

As illustrated in FIG. 3, the table top 12 is shown from the underside and revealing the bottom or underside surface 12*b* of the table top 12. The table top 12 is shown with the panel 19 secured to the upper support 18 with a plurality of bands 60. The bands 60 preferably are comprised of fabric and more preferably, the same fabric as the table top panel 19. According to some preferred embodiments, the table top panel 19 and bands 60 may be continuous therewith, with the bands 60 being formed or provided as part of the panel 19. Alternately, the bands 60 may be attached to the panel 19 at edge seams. Four bands 60 are illustrated, but other numbers and configurations of bands may be used to secure the table panel 19 to the upper support 18. The bands 60 are shown radially configured, disposed about the perimeter of the table top 12, and being folded over the edges of the table 10. Preferably, the table top 12 is foldable, with the upper support 18 and panel 19 being folded together.

According to a preferred configuration, the upper support 18 is constructed having two sections. In one preferred embodiment, as illustrated in FIG. 3, the upper support 18 includes a first upper support section 18*a* and a second upper support section 18*b*. Connectors 62*a*,62*b* are provided to connect the first upper support section 18*a* and second upper support section 18*b*. Preferably, the connector 62*a* connects with one end 18*c* of the first upper support section 18*a* and an adjacent end 18*d* of the second upper support section 18*b*. Preferably, the end 18*c* of the first upper support section 18*a* is pivotally connected to the connector 62*a* with a fastener 22, and the adjacent end 18*d* of the second upper support section 18*b* also is pivotally connected to the connector 62*a* with a fastener 22. According to a preferred embodiment, as illustrated in FIG. 3, each end of the first upper support section 18*a* and each end of the second upper support section 18*b* makes an independent pivotal connection with a connector 62*a*, 62*b*, so that four pivot connections are established, two at each connector 62*a*,62*b*. As illustrated in FIG. 3, the connector 62*a* is shown having a floor 63*a* and a pair of side walls 64*a*. Similarly, the connector 62*b* may be constructed in the same manner. Optionally, the side walls 64*a* of the connector 62*a* may be tapered or formed with a lip at their free ends to facilitate locking onto the upper support 18. The connector 62*b* may be similarly constructed.

The table top 12 is provided to be removably installed on and detached from components of the frame 11. According to a preferred embodiment, the upper support 18 and panel 19 may be attached to and removed from the lower frame components, namely, the legs 11*a*,11*b*,11*c*,11*d* and upper connectors, 15*a*,15*b*,15*c*,15*d*. According to one embodiment, optionally, the table panel 19 may be removed from the upper support for cleaning. According to a preferred embodiment, the panel 19 is fixedly connected to the upper support 18 to provide suitable tension for the table top surface 12*a* when the table 10 is constructed by securing the upper support 18 on the connectors 15*a*,15*b*,15*c*,15*d*. The upper connectors 15*a*,15*b*, 15*c*,15*d*, as illustrated in FIG. 1, secure the table top 12 on the frame 11. As shown in the enlarged view in FIG. 2, the upper connector 15*b* has a sleeve 33*b* and a locking arm 34*b*. The upper connectors 15*a*,15*c*,15*d* also preferably are configured with sleeves 33*a*,33*c*,33*d* and locking arms 34*a*,34*c*,34*d*, respectively. Each locking arm 34*a*,34*b*,34*c*,34*d* connects the table top 12 to the frame 11. Preferably, each locking arm 34*a*,34*b*,34*c*,34*d* connects with the upper support 18 to secure the table top 12 onto the frame 11. According to a preferred embodiment, as best illustrated in FIG. 2, locking arm 34*b* includes a pair of flexible side walls 35*b*, 36*b* and a groove 37*b*. Preferably, the groove 37*b* is contoured similar to the configuration of the upper support 18. According to a preferred embodiment, where the upper support 18 is configured as a tube or circumferential element, the groove 37*b* is radially matched (and is slightly larger than the tube radius) to accommodate the upper support 18 therein. Optionally, the side walls 35*b*, 36*b* preferably may be configured with lips or inturned wall portions which snap over the upper support 18 and hold the upper support on the upper connector 15*b*. The side walls 35*b*,36*b* (as well as the upper connectors 15*a*,15*b*, 15*c*,15*d*) may be constructed from a resilient material, such as, for example, plastic. The other upper connectors 15*a*,15*c*, 15*d* preferably connect with the upper support 18 in the manner described and shown in connection with the upper connector 15*b*. The bands 60 or table top panel 19 preferably are connected to the upper support 18 to provide areas of access to the upper support 18 when the panel 19 is installed thereon so that the upper connectors 15*a*,15*b*,15*c*,15*d* may securely connect to locations along the upper support 18.

Referring to FIGS. 1 and 3, the table top 12 preferably includes a plurality of apertures 50 therein which define openings to wells 51. The wells 51 preferably comprise pockets constructed of a flexible material that allows for the wells 51 to be folded or collapsed as needed when the table top 12 is folded or collapsed. The wells 51 preferably may be constructed from a mesh material and have a bottom 52 and side wall 53. According to a preferred embodiment, the bottom 52 and side wall 53 may be formed as a continuous unit, and alternately, the bottom 52 and side wall 53 may be separate components that are attached together to form the well 51. The side wall 53 preferably has a first end that is attached to, or forms, the bottom 52, and a second end, opposite the first end, which is secured to the table panel 19, for example, at the location of an aperture 50. Preferably, a flange 54 is provided at the aperture 50 and may be used to secure the material forming the wells 51, such as, for example, the side wall 53, to the table panel 19. The flange 54 may comprise a snap ring. Alternate attachment means may be used to secure the wells 51 to the table panel 19, including, for example, a seam with threads or welds, fabric binding or other securing components that attach the second end of the side wall 53 to the table top panel 19.

The wells 51 preferably are dimensioned to hold a beverage container, such as, for example, bottles 100, 101, cans (not shown) or another vessel. The wells 51, although illustrated as being similar in dimension to each other, may be provided having different dimensions or with varied sizes (e.g., where some wells 51 are larger or deeper than others). In addition, the number of wells 51 may be greater or lesser in number than the four depicted in the drawing figures.

The table 10, according to a preferred embodiment, is adjustable in height so that the table 10 may be adjustably positioned to a desired height. As shown in FIG. 1, the table 10 is illustrated in an extended or raised condition, with the legs 11*a*,11*b*,11*c*,11*d* in an expanded condition, where the table top 12 is raised away from the lower frame portion 20. FIG. 1 illustrates the table top 12 in a phantom-line view representing a lower position. Although not shown, when the table top 12 is in the lower (phantom-line) position, the sleeves 33*a*,33*b*,33*c*,33*d* of the upper connectors 15*a*,15*b*, 15*c*,15*d*, respectively, are positioned at the level of the upper stops 40*a*,40*b*,40*c*,40*d*. Upper stops 40*a*,40*b*,40*c*,40*d* are disposed at the top of each lower leg section 30*a*,30*b*,30*c*,30*d*, respectively, for supporting the upper connectors and the table top surface 12 at a lowered position (see FIG. 1). The upper stops 40*a*,40*b*,40*c*,40*d* preferably may comprise ferrules or bushings that fit on the ends of the top edge of each lower leg section 30*a*,30*b*,30*c*,30*d*, respectively. Referring to FIG. 2, an enlarged view is shown with the upper connector 15*b* resting on the upper stop 40*b*.

Figure 4:
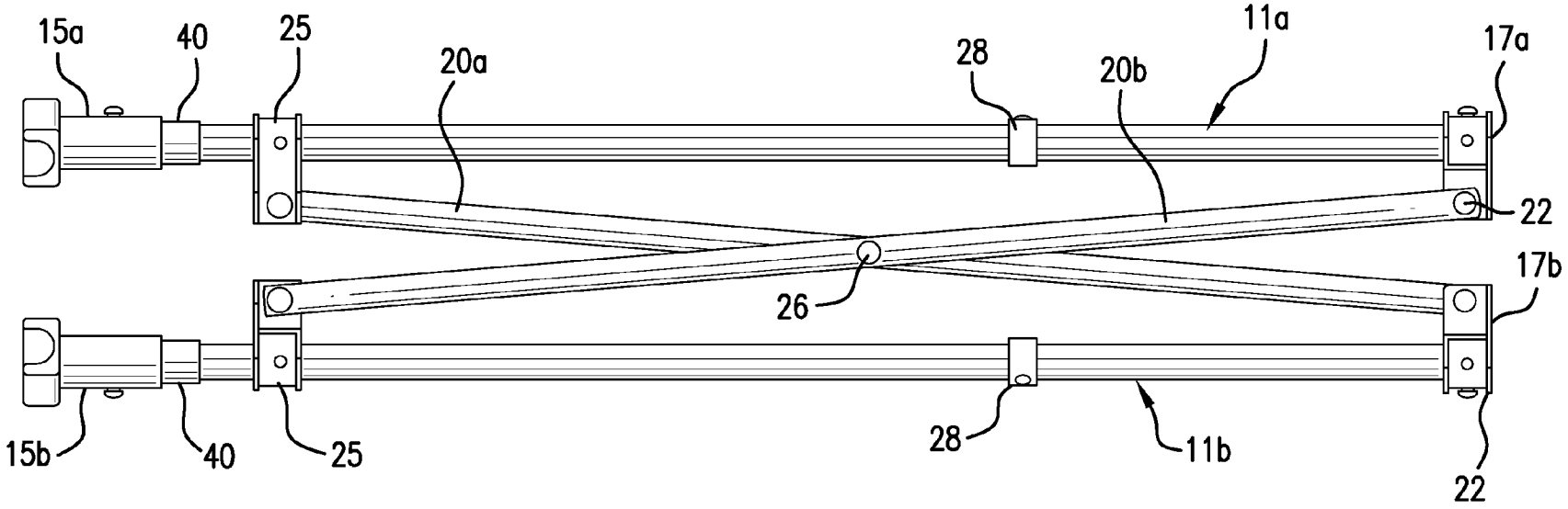
FIG. 4 is a front elevation view of the frame of the table of FIG. 1, shown turned on its side and in a collapsed condition, and separately from the table top and upper support.

The table 10 may be collapsed from its expanded condition (FIG. 1) to the folded condition (see FIGS. 4 and 5). The folding of the table 10 is accomplished by removing the table top 12 from the upper supports 15*a*,15*b*,15*c*,15*d*, and sliding the sliders 25 along the legs 11*a*,11*b*,11*c*,11*d* in a direction away from the lower connectors 17*a*,17*b*,17*c*,17*d* (see FIG. 5). During the sliding movement of the sliders 25 along each of the lower leg sections 30*a*,30*b*,30*c*,30*d*, the support member pairs 20*a*,20*b* and 20*c*,20*d* and 20*e*,20*f* and 20*g*,20*h* pivot and move to align with the legs 11*a*,11*b*,11*c*,11*d*, as illustrated in FIG. 4 (showing the collapsed frame 11). The table top 12 and upper support 18, which has been removed from the frame 11, also may be folded, and may form a half-circle. Preferably, the folding of the table top 12 folds the panel 19 and upper support 18. The wells 51 also collapse as needed.

An optional carrying case 110 is provided, and the table 10, when folded in the configuration shown in FIG. 4, may be placed within the carrying case 110 (FIG. 7) for storage and transport. A handle 111 preferably is provided on the case 110. Although not shown, a handle may be provided on the frame 11, on the table top 12 (including on the underside surface or side edge), or both, to facilitate transport of the table 10.

Referring to FIG. 1, the table 10 may be folded for storage by first removing the top 12. The table top 12 preferably may be removed from other components of the frame 11 with the upper support 18 still attached to the table top 12. The upper support 18 is released from the locking arms 34*a*,34*b*,34*c*,34*d* by lifting and preferably tilting the table top 12 away from the locking arms 34*a*,34*b*,34*c*,34*d*. Preferably, this is done by lifting one of the upper support sections 18*a*,18*b* upward relative to the other upper support section 18*a*,18*b*. When the upper support 18 is released from each locking arm 34*a*,34*b*, 34*c*,34*d*, then the table frame 11 (or position from which the top 12 and upper support 18 have been detached) may be collapsed for storage. Referring to FIG. 5, to collapse the table 10 from a raised height position, the frame 11 is collapsed by depressing the pins 55 (e.g., inwardly) away from the upper apertures 56 (see FIG. 6) and lowering each upper leg section 31*a*,31*b*,31*c*,31*d* into its respective lower leg section 30*a*,30*b*,30*c*,30*d*. According to a preferred method, each upper leg section 31*a*,31*b*,31*c*,31*d* carries a pin 55, and, when lowered into each respective lower leg section 30*a*,30*b*,30*c*, 30*d*, the pin 55 seats in the lower pin aperture 59. The sliders 25 on each lower leg section 30*a*,30*b*,30*c*,30*d* are then slid upwardly along the respective lower leg sections 30*a*,30*b*, 30*c*,30*d* as the lower support 20 collapses (from its FIG. 1 position to the collapsed condition shown in FIG. 4), with the support members 20*a*,20*b*,20*c*,20*d*,20*e*,20*f*,20*g*,20*h* pivoting (as shown in FIGS. 4 and 5) and moving adjacently closer to each other. Preferably, the sliders 25 are moved closer to each other and may engage each other at the end of the collapsing movement (see FIG. 4). The table top 12 and the upper support 18 attached thereto, for example, may be folded in half to form a semi-circle (in the configuration illustrated where the table top 12 is circular). The frame 11 and table top 12 may be stored together in a carry case or lightweight bag 110 for ease of storage and transport. Although a preferred folding method is discussed, alternate folding methods may be used to collapse and expand the table. Alternately, when the table 10 is in the lowered height position (represented by the phantom-line position in FIG. 1), preferably, the pins 55 may already be seated in the lower apertures 59 formed in each lower leg section 30*a*,30*b*,30*c*,30*d*. Then the sliders 25 may be moved upward along the legs 11*a*,11*b*,11*c*,11*d* by bringing the legs and lower supports together and/or moving the sliders 25. The sliders 25 may move past the pins 55, and may depress them as they move, but preferably, the pins 55 continue to remain in the lower apertures 59.

While the invention has been described with reference to specific embodiments, the description is illustrative and is not to be construed as limiting the scope of the invention. These and other various modifications and changes may occur to those skilled in the art without departing from the spirit and scope of the invention described herein.

What is claimed is:

1. A portable collapsible table, comprising:

a foldable supporting frame;

a table top;

said frame including a plurality of legs;

wherein said table top comprises a foldable panel and a frame support that removably attaches said table top to said foldable supporting frame by releasably locking said table top to said supporting frame; and wherein when said frame support attaches to said foldable supporting frame said frame support fixes said legs in a supportive position;

wherein said frame support is foldable.

2. The table of claim 1, wherein said table top includes a surface having a plurality of apertures therein.

3. The table of claim 2, wherein said apertures define openings into wells, and wherein said wells comprise pockets.

4. The table of claim 3, wherein said wells comprise mesh pockets.

5. The table of claim 1, wherein said frame has a lower support, and wherein said lower support includes a plurality of lower support members that are slidably mounted on said legs.

6. The table of claim 5, wherein said lower support members are provided in pairs, wherein members of each pair are pivotally connected to each other for relative pivotal movement.

7. The table of claim 6, wherein said legs are adjacently arranged, and wherein each lower support member has a first end that is slidably mounted to one of said plurality of legs, and wherein each lower support member has a second end that is pivotally mounted to the lower end of a said first leg section of an adjacent leg.

8. The table of claim 7, including a plurality of sliders, and wherein each said slidably mounted lower support member is pivotally connected to one of said sliders, and wherein a slider of said plurality of sliders is slidably carried on each of said legs.

9. The table of claim 6, wherein each leg first leg section has an upper end that receives the second leg section, wherein each leg first leg section has a lower end, wherein a lower connector is mounted on each said first leg section lower end, and wherein said lower connector pivotally connects to the ends of two lower support members which said two lower support members comprise lower support members of different lower support member pairs.

10. A portable collapsible table, comprising:

a foldable supporting frame;

a table top;

said frame including a plurality of legs;

wherein said table top comprises a foldable panel and a frame support that removably attaches said table top to said foldable supporting frame by releasably locking said table top to said supporting frame;

wherein when said frame support attaches to said foldable supporting frame said frame support fixes said legs in a supportive position; and wherein said legs are positionable in a first position that positions the table top in a first relatively low position and in a second position that positions the table top in a second relatively raised position.

11. The table of claim 10, wherein said legs include a first section and a second section, wherein said second section is receivable within said first section and is extendible in a direction outwardly therefrom.

12. The table of claim 11, wherein said frame support comprises an upper frame support, wherein upper connectors connect said legs to said upper frame support, and wherein each second leg section has a first end that is received and held in said first leg section, and wherein each second leg section has a second end that connects to a said upper connector.

13. The table of claim 12, wherein said frame has a lower support, and wherein said lower support includes a plurality of lower support members that are slidably mounted on said legs.

14. The table of claim 13, wherein said lower support members are provided in pairs, and wherein members of each said support member pair are pivotally connected to each other for relative pivotal movement.

15. The table of claim 14, wherein said legs are adjacently arranged, and wherein each lower support member has a first end slidably mounted to one of said plurality of legs, and wherein each lower support member has a second end mounted to the lower end of a said first leg section of an adjacent leg.

16. The table of claim 15, including a plurality of sliders, and wherein each said slidably mounted lower support member is pivotally connected to one of said sliders, and wherein a slider of said plurality of sliders is slidably carried on each of said legs.

17. The table of claim 14, wherein each leg first leg section and a lower end, wherein each said first leg section has an upper end that receives the second leg section, and wherein a lower connector is mounted on each said first leg section lower end, and wherein said lower connector pivotally connects to the ends of two lower support members which said two lower support members comprise lower support members of different lower support member pairs.

18. The table of claim 12, further including a locking mechanism, wherein said upper leg sections are lockable in a raised position where said upper leg sections are raised relative to said lower leg sections, and wherein said locking mechanism locks said upper connectors into an alignment position corresponding to a position where said upper connectors connect with said frame support of said table top.

19. A portable collapsible table, comprising:

a foldable supporting frame;

a table top;

said frame including a plurality of legs;

wherein said table top comprises a foldable panel and a frame support that removably attaches said table top to said foldable supporting frame by releasably locking said table top to said supporting frame;

wherein when said frame support attaches to said foldable supporting frame said frame support fixes said legs in a supportive position; and including upper connectors that connect said frame support to said supporting frame, wherein said frame support removably attaches said table top to the foldable supporting frame by releasably locking the table top to the upper connectors of the supporting frame, and wherein when said frame support attaches to said upper connectors of said foldable supporting frame said frame support fixes said legs in a supportive position.

20. A portable collapsible table, comprising:

a foldable supporting frame;

a table top;

said frame including a plurality of legs;

wherein said table top comprises a foldable panel and a frame support that removably attaches said table top to said foldable supporting frame;

wherein said legs are positionable in a first position that positions the table top in a first relatively low position and in a second position that positions the table top in a second relatively raised position;

wherein said legs include a first section and a second section, wherein said second section is receivable within said first section and is extendible in a direction outwardly therefrom;

wherein said frame support comprises an upper frame support, wherein upper connectors connect said legs to said upper frame support, and wherein each second leg section has a first end that is received and held in said first leg section, and wherein each second leg section has a second end that connects to a said upper connector; and wherein when said frame support attaches to said foldable supporting frame said frame support fixes said legs in a supportive position.

21. The table of claim 20, wherein said upper frame support and said foldable panel are removably attachable to and detachable from said supporting frame.

22. The table of claim 1, wherein said frame support is carried on said table top.

23. The table of claim 22, wherein said frame support is foldable with said table top.

24. The table of claim 1, wherein said frame support removably attaches said table top to said foldable supporting frame so that when said table top is lifted, said foldable supporting frame attached thereto is lifted therewith.

25. A portable collapsible table, comprising:

a foldable supporting frame;

a table top;

said frame including a plurality of legs;

wherein said table top comprises a foldable panel and a frame support that removably attaches said table top to said foldable supporting frame by releasably locking said table top to said supporting frame;

wherein when said frame support attaches to said foldable supporting frame said frame support fixes said legs in a supportive position; and wherein said frame support includes a plurality of sections and wherein support section connectors are carried on said frame support and are movable to at least one position that is a locking position where said support section connectors lockingly engage said frame support sections together, and are movable to release said support section connectors from said locking position.

26. The table of claim 25, wherein said frame support sections are connected together with said support section connectors and wherein said support section connectors are pivotally carried on said frame support sections.

27. A portable collapsible table, comprising:

a foldable supporting frame;

a table top;

said frame including a plurality of legs;

wherein said table top comprises a foldable panel and a frame support that removably attaches said table top to said foldable supporting frame by releasably locking said table top to said supporting frame;

wherein when said frame support attaches to said foldable supporting frame said frame support fixes said legs in a supportive position;

wherein said frame support is carried on said table top; and wherein said frame support is foldable with said table top.

* * * * *